US010286232B2

(12) United States Patent
Ostrobrod

(10) Patent No.: US 10,286,232 B2
(45) Date of Patent: May 14, 2019

(54) REMOTE OVERHEAD ANCHOR SYSTEM

(71) Applicant: Meyer Ostrobrod, Philadelphia, PA (US)

(72) Inventor: Meyer Ostrobrod, Philadelphia, PA (US)

( * ) Notice: Subject to any disclaimer, the term of this patent is extended or adjusted under 35 U.S.C. 154(b) by 0 days.

(21) Appl. No.: 15/627,923

(22) Filed: Jun. 20, 2017

(65) Prior Publication Data

US 2018/0361176 A1 Dec. 20, 2018

(51) Int. Cl.

| | |
|---|---|
| ***A62B 1/10*** | (2006.01) |
| ***A62B 35/00*** | (2006.01) |
| ***E06C 7/18*** | (2006.01) |

(52) U.S. Cl.

CPC ..... *A62B 1/10* (2013.01); *A62B 35/0093* (2013.01); *E06C 7/18* (2013.01); *A62B 35/0068* (2013.01)

(58) Field of Classification Search

CPC ... A62B 1/10; A62B 35/0093; A62B 35/0068; E06C 7/18

See application file for complete search history.

(56) References Cited

U.S. PATENT DOCUMENTS 4,511,123 A * 4/1985 Ostrobrod ..... A62B 35/0093 182/234
5,579,564 A * 12/1996 Rullo ..... F16B 45/02 24/599.4
5,622,399 A * 4/1997 Albright ..... A62B 1/18 294/24
5,829,548 A 11/1998 Ostrobrod
6,412,432 B1 * 7/2002 White ..... B63B 21/04 114/221 R
7,395,984 B2 * 7/2008 Szarkowski ..... B65H 75/4434 242/384
8,398,134 B1 * 3/2013 Mortensen ..... B66F 19/00 248/925
8,955,203 B2 * 2/2015 Tardif ..... F16B 45/02 24/599.5

(Continued)

FOREIGN PATENT DOCUMENTS

EP -3002045 A1 * 4/2016
EP 3002045 A1 * 4/2016 ..... E04G 21/3204

*Primary Examiner* — Katherine W Mitchell
*Assistant Examiner* — Candace L Bradford
(74) *Attorney, Agent, or Firm* — Norman E. Lehrer

(57) ABSTRACT

A remote overhead anchor system for use at an elevated overhead position and adapted to be secured to a ring or similar anchor point includes a substantially U or C shaped hook with two ends, one of which is adapted to pass through the anchor point to secure the hook to the anchor point. A latch is pivotally connected adjacent the other end of the U and can move between a closed position wherein it engages the first end and an opened position wherein it is spaced therefrom and a spring biases the latch into the closed position. To prevent the latch from unintentionally opening, a lock mechanism is carried by the other end of the U shaped hook and engages the lever. A conically shaped receiver secured to the hook faces downwardly to receive the upper end of an elongated vertically extending pole. A manually operable remote actuator including a cord extending downwardly from the anchor substantially the length of the pole is adapted to first unlock the lock mechanism and then subsequently move the latch into its opened position.

4 Claims, 4 Drawing Sheets

(56) References Cited

U.S. PATENT DOCUMENTS

| | | | | |
|---|---|---|---|---|
| 9,199,105 | B1 * | 12/2015 | Hung | A62B 35/0068 |
| 9,469,025 | B1 * | 10/2016 | Ostrobrod | A62B 35/0068 |
| 2005/0242602 | A1 * | 11/2005 | Protesto | B66C 1/36 294/82.21 |
| 2006/0021825 | A1 * | 2/2006 | An | A62B 35/0093 182/236 |
| 2008/0169155 | A1 * | 7/2008 | Broberg | A01M 31/02 182/187 |
| 2010/0226748 | A1 * | 9/2010 | Wolner | A62B 35/0093 414/815 |
| 2011/0168488 | A1 * | 7/2011 | Simard | A62B 1/14 182/5 |
| 2012/0210542 | A1 * | 8/2012 | Yang | F16B 21/165 24/369 |
| 2013/0025095 | A1 * | 1/2013 | Yang | F16B 45/02 24/599.5 |
| 2017/0189728 | A1 * | 7/2017 | Kekahuna, IV | A62B 35/0068 |
| 2017/0252591 | A1 * | 9/2017 | Hetrich | A62B 35/0093 |
| 2017/0291049 | A1 * | 10/2017 | Hetrich | A62B 35/0093 |
| 2017/0326429 | A1 * | 11/2017 | Strasser | A62B 35/0056 |

* cited by examiner

REMOTE OVERHEAD ANCHOR SYSTEM

BACKGROUND OF THE INVENTION

The present invention is directed toward a remote overhead anchor and more particularly, toward such a remote overhead anchor adapted to be secured to a ring or other overhead anchor point to support a worker along with a personal fall arrest or protection system and which cannot accidentally disconnect from the overhead anchor point.

When a workman is working in high places in buildings and other structures, OSHA and the safety rules and regulations in most states and foreign countries require the use of a personal fall arrest or protection device. Such devices protect a workman from injury by quickly slowing and then stopping further downward motion in the event the workman falls from an elevated position. Such fall protection devices are, per se, well known in the art. See, for example, U.S. Pat. Nos. 4,511,123 and 5,829,548, both of which issued to the present applicant. The entire contents of these prior parents are incorporated herein by reference.

In use, the workman wears a harness which is connected to a retractable cable coming from the fall protection device. In order for the system to operate properly, however, the cable must extend downwardly from a position above (or at least at or near the height) where the workman is working. This requires that either the fall protection device or at least a pulley for the cable be located at an elevated position above the workman.

Unfortunately, there are many situations where there simply is no anchor or like in the vicinity of where the fall protection device or cable pulley must be located. Frequently, there is nothing present but overhead rafters or beams or similar structures. A solution to this problem is to hang a strap over the beam and use the strap as an anchor point. The strap is comprised of a length of strong webbing or other flexible fabric material that has a D-ring or O-ring at each end. One of the rings is larger than the other. After the strap is hung over the beam, the smaller ring is passed through the larger one. The smaller ring becomes the anchor point.

A problem did exist as to how to get the strap in position over the beam. Climbing a ladder to place the strap in position creates more of a safety problem and obviously makes the situation even more dangerous. This problem was solved by the current inventor's invention of a remote anchor installation tool as described in U.S. Pat. No. 9,469,025, the entire contents of which is incorporated herein by reference.

With the ring or other anchor point in place, a long pole (such as shown in the '025 patent) can be used to connect or remove an anchor or hook which carries the fall protection device or the cable from the fall protection device. While this, by itself, is not a difficult task, safety rules require that there be a means for preventing the anchor from inadvertently disengaging the anchor point. Having a spring latch such as used in a carabiner or the like is not sufficient. The rules require that the latch be locked closed so that the anchor cannot inadvertently fall off. This creates a difficult problem when the anchor is high above the around.

A need exists, therefore, for a fall protection anchor that makes it easy for a worker from the ground to quickly place the same in position overhead and which makes it easy to remove the same while still preventing the inadvertent disengagement of the anchor.

SUMMARY OF THE INVENTION

The present invention is designed to overcome the deficiencies of the prior art discussed above. It is an object of the present invention to provide an overhead anchor system that can be attached to and removed from an overhead ring or similar anchor point from the ground.

It is another object of the present invention to provide such an anchor system which includes a locking member to prevent the anchor from inadvertently opening when installed on the anchor point.

It is a still further object of the present invention to provide such an anchor system that includes a means for remotely unlocking the locking member by a workman on the ground.

In accordance with the illustrative embodiments demonstrating features and advantages of the present invention, there is provided a remote overhead anchor system for use at an elevated overhead position and which is adapted to be secured to a ring or similar anchor point. The system includes a substantially U or C shaped hook with two ends, one of which is adapted to pass through the anchor point to secure the hook to the anchor point. A latch is pivotally connected adjacent the other end of the U and can move between a closed position wherein it engages the first end and an opened position wherein it is spaced therefrom and a spring biases the latch into the closed position. To prevent the latch from unintentionally opening, a lock mechanism is carried by the other end of the U shaped hook and engages the lever. A conically shaped receiver secured to the hook faces downwardly to receive the upper end of an elongated vertically extending pole. A manually operable remote actuator including a cord extending downwardly from the anchor substantially the length of the pole is adapted to first unlock the lock mechanism and then subsequently move the latch into its opened position.

Other objects, features, and advantages of the invention will be readily apparent from the following detailed description of the preferred embodiment thereof taken in conjunction with the drawings.

BRIEF DESCRIPTION OF THE DRAWINGS

For the purpose of illustrating the invention, there is shown in the accompanying drawings one form which is presently preferred; it being understood that the invention is not intended to be limited to the precise arrangements and instrumentalities shown.

DETAILED DESCRIPTION OF THE PREFERRED EMBODIMENT

Figure 2:
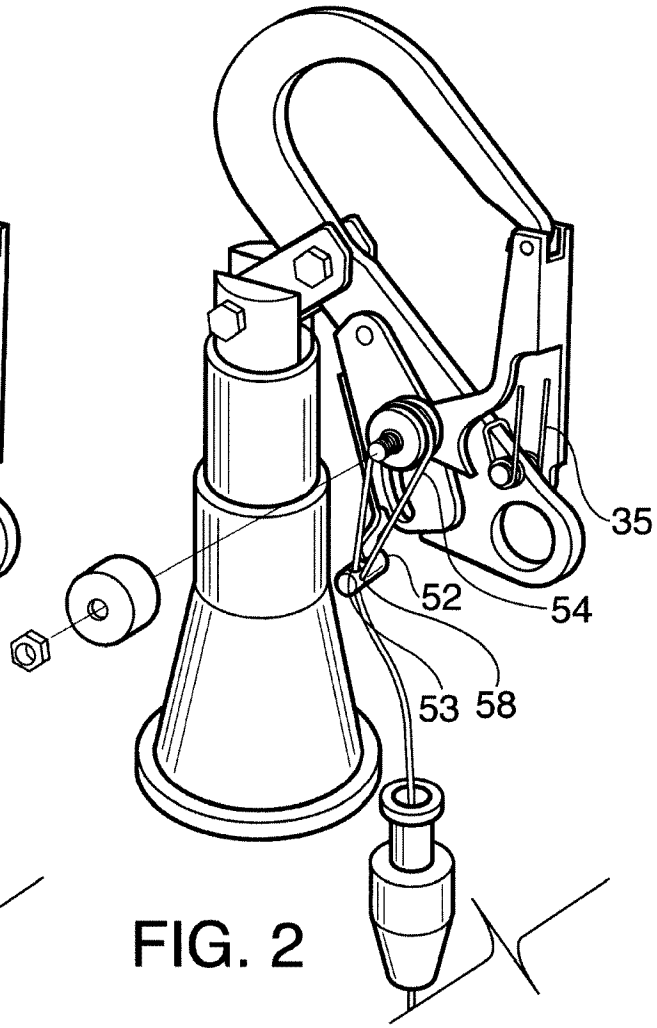
FIG. 2 is a front perspective view similar to FIG. 1 but showing parts removed for clarity.
Figure 1:
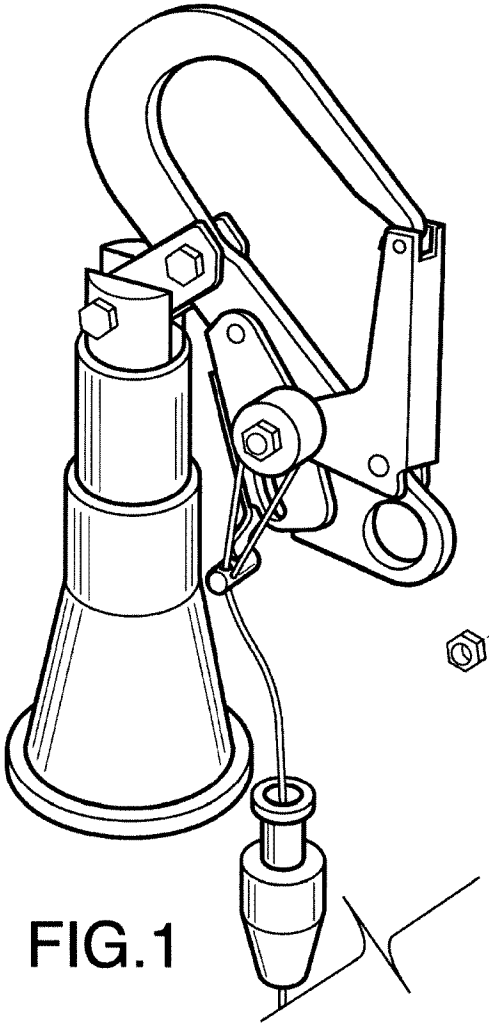
FIG. 1 is a front perspective view of the remote overhead anchor of my invention.
Figure 12:
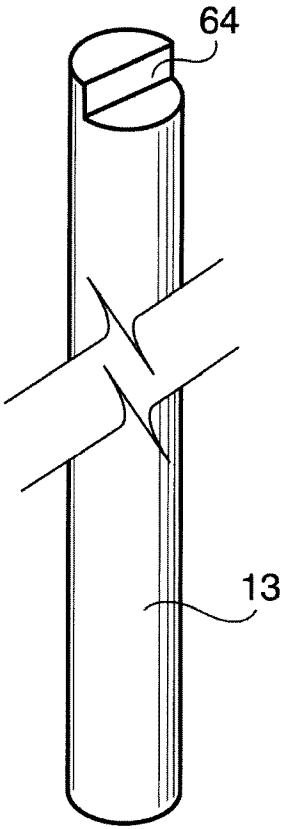
FIG. 12 is a front perspective view of the top end of the elongated vertical pole used to install and uninstall the anchor system on the overhead anchor point.

Referring now to the drawings in detail wherein like reference numerals have been used throughout the various figures to designate like elements, there is shown in the FIGS. 1-11 a remote overhead anchor constructed in accordance with the principles of the present invention and designated generally as 10. The remote overhead anchor system 10 is primarily designed to be connected to a ring or other overhead anchor point such as shown at 12 in FIGS. 3-5. As will be discussed later, this is accomplished from the ground or floor utilizing an elongated telescoping pole 13 as described more fully in U.S. Pat. No. 9,469,025.

Figure 5:
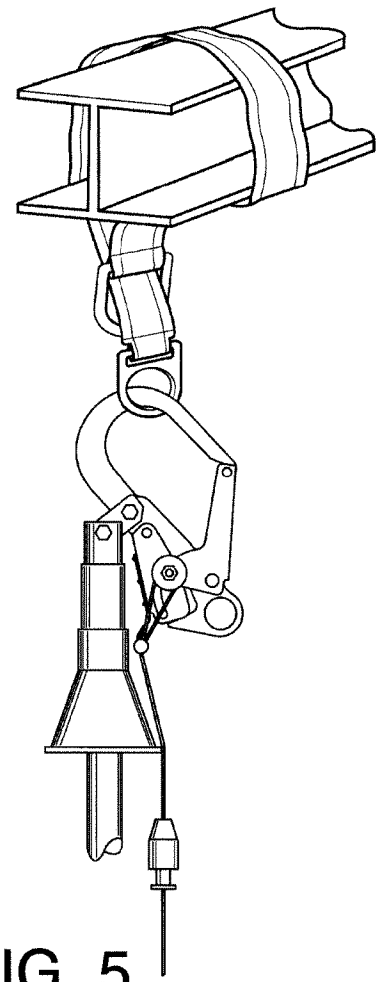
FIGS. 3, 4 and 5 illustrate the anchor being secured to a ring or other overhead anchor point.
Figure 4:
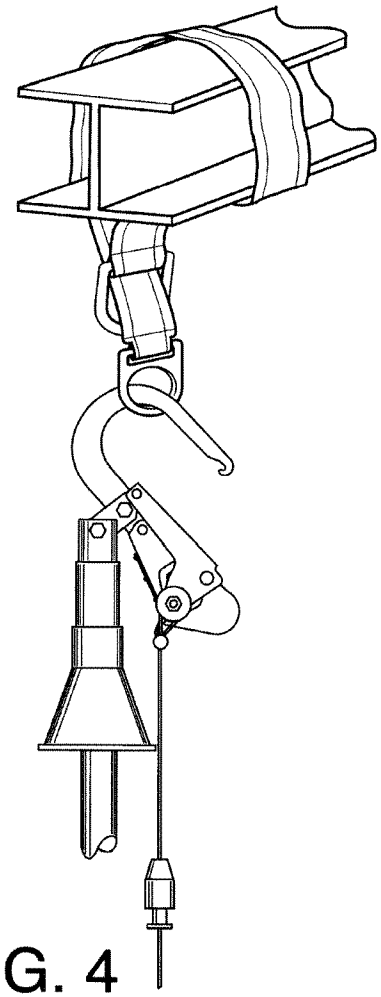
Figure 3:
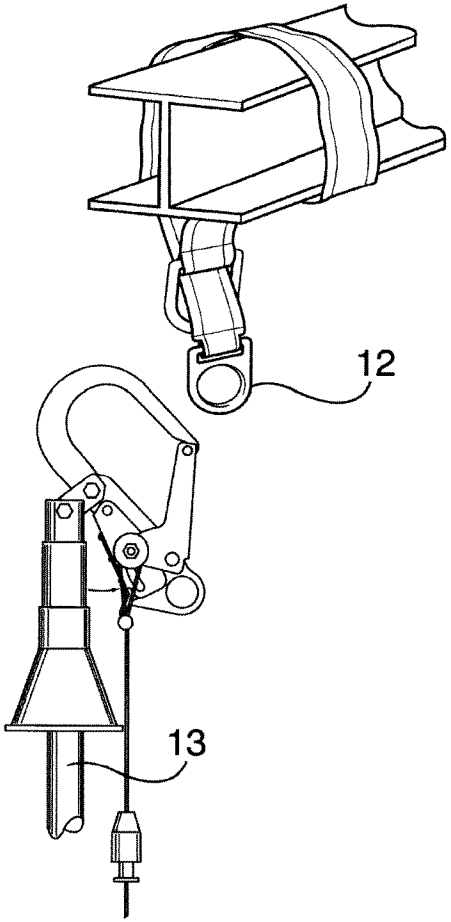

The anchor 10 is comprised of a substantially U or C shaped hook 14 having first and second legs 16 and 18. The first leg 16 includes a first free end 20 that is adapted to pass through the anchor point 12 as shown in FIGS. 4 and 5. The second leg 18 also includes a free end 22 that includes an opening or eye 24 through which the fall protection equipment or the cable from the fall protection equipment can be attached in the known manner.

Figure 11:
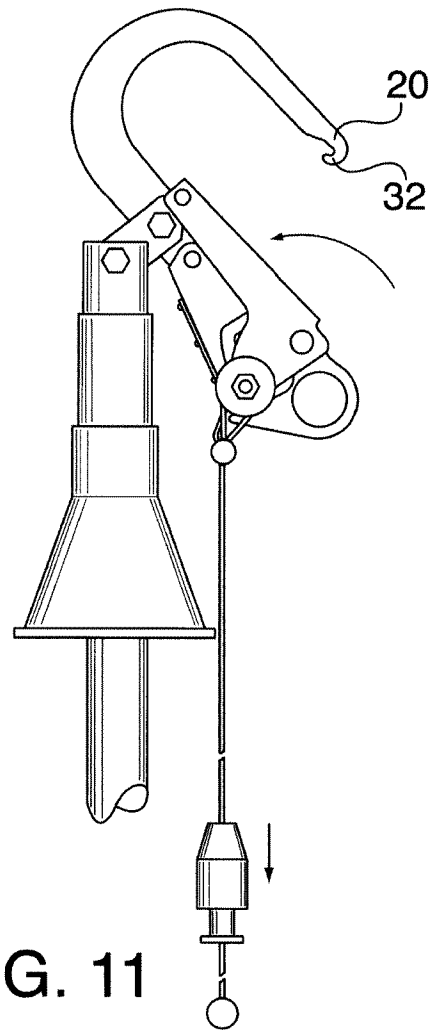
FIGS. 9, 10 and 11 illustrate the operation of the anchor mechanism.
Figure 10:
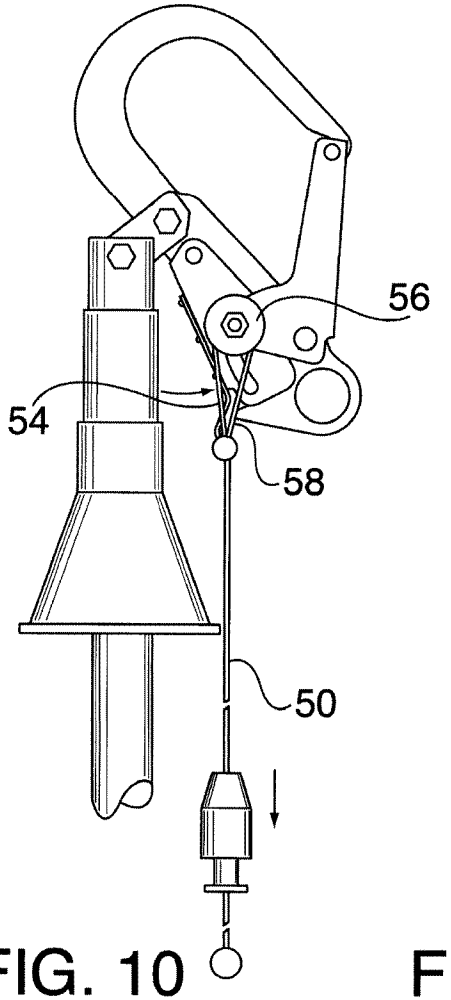
Figure 9:
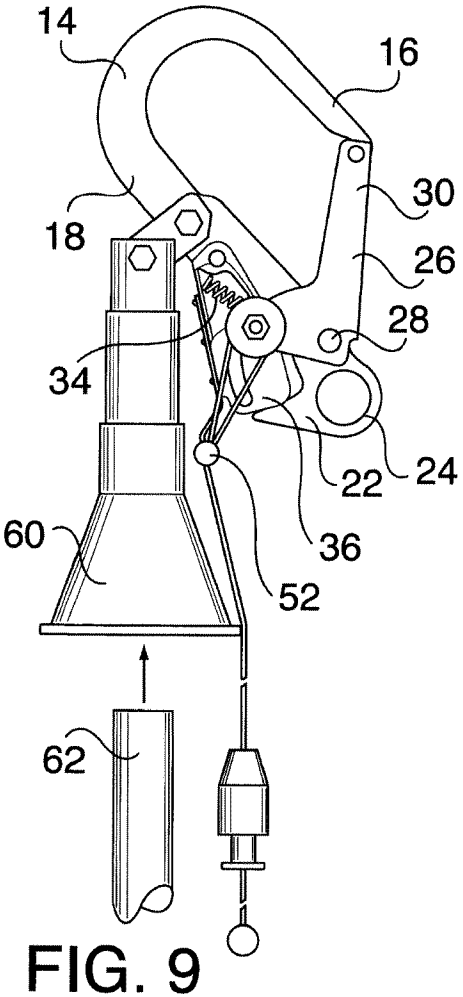

A latch 26 is pivotally attached to the second free end 22 of the second leg 18 at pivot point 28. The latch 26 is adapted to move between a closed position such as shown in FIGS. 9 and 10 wherein the upper end 30 thereof engages the first free end 16 of the first leg 14 and an opened position such as shown in FIG. 11 which would allow the free end 20 to enter the anchor point 12 or to be removed therefrom. The free end 20 of the first leg 16 includes a small hook or stop member 32 that prevents the latch 26 from traveling past the free end 20. A torsion spring means 35 (see FIG. 2) biases the latch 26 into the closed position.

Figure 7:
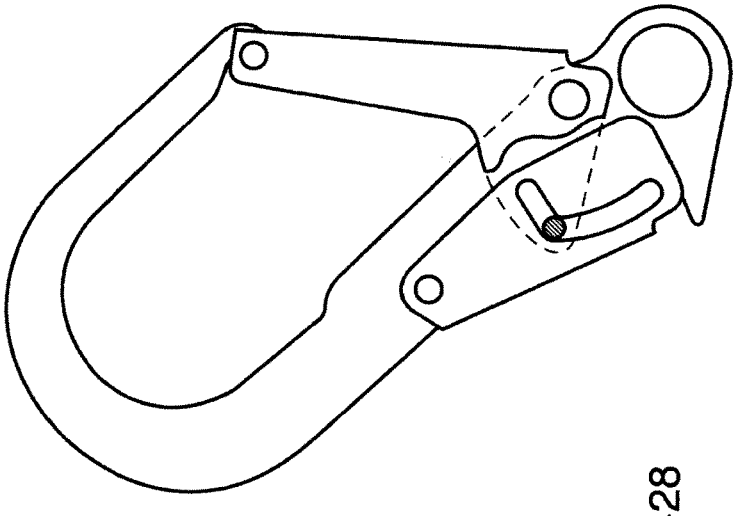
Figure 6:
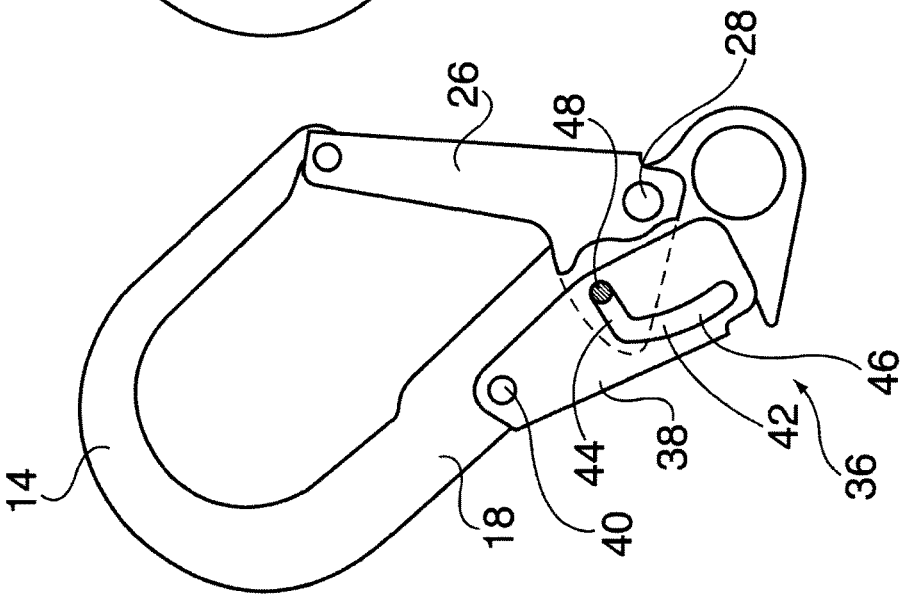

A locking means 36 carried by the second end 22 of the second leg 18 of the hook 14 is movable between a locked position such as shown in FIGS. 6 and 9 for maintaining the latch 26 in its closed position and an unlocked position such as shown in FIGS. 7 and 10 wherein the latch 26 can be moved into its opened position. It is, however, biased into the closed or locked position by the coil spring 34.

Figure 8:
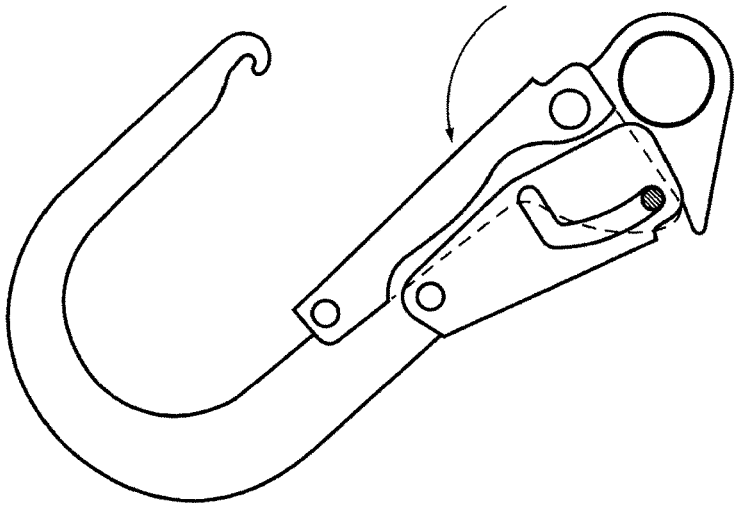
FIGS. 6, 7 and 8 illustrate the manner in which the locking mechanism operates to prevent the hook from inadvertently opening.

As shown best in FIGS. 6, 7 and 8, the locking means 36 is comprised of a lever 38 pivoted at pivot point 40 to the second leg 18 of the hook 14. The lever 38 includes a slot 42 formed therein which includes an upper first straight leg 44 and a second lower arcuate leg 46. The latch 26 includes a pin 48 which extends through the slot 42.

As shown most clearly in FIG. 6, when the pin 48 lies in the upper straight portion 44 of the slot 42, the latch 26 cannot open inadvertently since the pin engages the bottom wall of the slot portion 44. This is the locking position of the lock mechanism 36 discussed above. As the lever 38 moves toward the latch 26 (that is, to the right as shown in FIG. 7), the pin 48 lies above the lower curved section 46 of the slot 42. At this point, the pin 48 can move downwardly through the arcuate slot 46 to open the latch 26 as shown in FIG. 8.

The above movement is accomplished through the use of an actuator means which is manually operable from a remote position. The actuator includes an elongated cord 50 that extends downwardly the entire length of the pole 13 so that it can be controlled by a person standing on the floor beneath the anchor. A knob 52 is secured to the bottom of the lever 36 and includes an opening 53 therein through which the cord 50 can pass upwardly. The upper end 54 of the cord 52 then passes around the pulley 56 that is secured to the pin 48. The remote end 58 of the cord 50 is then fixedly secured to the knob 52.

As a result of the foregoing arrangement, when there is no downward force on the cord 50, the lever 38 is biased into its outward position as shown in FIG. 9 by the spring 34 and the pin 48 lies in the upper slot portion 44 so that the latch 26 is locked. When a downward force is applied to the cord 50, the lever 38 is drawn to the right as viewed in FIGS. 7 and 10 so that the pin 48 moves into the unlocking position. Continued downward force on the cord 50 draws the pin 48 downwardly into the slot portion 46 thereby opening the latch 26.

In order to accomplish all of the foregoing from the ground, the anchor system includes a downwardly receiving conically shaped receiver 60 that is secured to the hook 14. The elongated vertically extending pole 13 engages the inner surface of the cone 60 so that the anchor system can be manipulated from the ground. Preferably, the upper end 62 of the pole 13 is non-round as shown at 64 so that it can engage a complementary slot within the receiver 60 thereby allowing the anchor system to be turned or otherwise manipulated from the ground.

The present invention may be embodied in other specific forms without departing from the spirit or essential attributes thereof and accordingly, reference should be made to the appended claims rather than to the foregoing specification as indicating the scope of the invention.

I claim:

1. A remote overhead anchor system for use at an elevated overhead position and adapted to be secured to an anchor point comprising:

a substantially U or C shaped hook including a first leg having a first free end and a second leg having a second free end, said first free end being adapted to pass through said anchor point to secure said hook to said anchor point;

a latch pivotally connected adjacent said second free end and adapted to move between a closed position wherein said latch engages said first free end and an opened position wherein said latch is spaced from said first free end;

spring means biasing said latch into said closed position;

locking means carried by said second free end and being movable between a locked position for maintaining said latch in said latch's closed position and an unlocked position wherein said latch can be moved into said latch's opened position, said locking means including a lever having an upper end and a lower end, said upper end of said lever being pivoted to said hook, said lever further including a slot therein and wherein said latch includes a pin extending into said slot and movable along the length of said slot, said slot including a first leg and a second leg and wherein said latch is locked when said pin is in said first leg of said slot and wherein said latch is capable of moving when said pin is in said second leg of said slot;

manually operable remote actuator means for moving said latch into said latch's opened position, said actuator means including a pulley carried by said latch and a knob with an opening therein secured to said locking means, said actuator means further including a cord having a first end secured to said knob, said cord then passing around said pulley and then extending downwardly through said opening in said knob, said cord having a second free end extending downwardly, whereby a downward force on said free end of said cord causes said locking means into said unlocked position and subsequently moving said latch into said opened position.

2. The anchor system as claimed in claim 1 further including a separate elongated vertically extending pole having an upper end and a receiver secured to said hook and facing downwardly to receive said upper end of said elongated vertically extending pole.

3. The anchor system as claimed in claim 2 wherein said receiver and upper end of said pole are so constructed such that rotation of the pole causes said hook to rotate.

4. The anchor system as claimed in claim 2 wherein at least a portion of said receiver is conically shaped in order to guide said upper end of said pole into said receiver.

* * * * *